US008984998B2

(12) United States Patent
Lee

(10) Patent No.: US 8,984,998 B2
(45) Date of Patent: Mar. 24, 2015

(54) AUTOMATIC ELECTRIC PUNCHING APPARATUS

(71) Applicant: Yong-Woo Lee, Seoul (KR)

(72) Inventor: Yong-Woo Lee, Seoul (KR)

( * ) Notice: Subject to any disclaimer, the term of this patent is extended or adjusted under 35 U.S.C. 154(b) by 82 days.

(21) Appl. No.: 14/015,060

(22) Filed: Aug. 30, 2013

(65) Prior Publication Data

US 2014/0338510 A1 Nov. 20, 2014

(30) Foreign Application Priority Data

May 20, 2013 (KR) ..... 10-2013-0056402

(51) Int. Cl.

| | |
|---|---|
| ***B26D 5/08*** | (2006.01) |
| ***B26F 1/02*** | (2006.01) |
| ***B26D 7/18*** | (2006.01) |
| *B26D 7/00* | (2006.01) |

(52) U.S. Cl.

CPC . *B26D 5/086* (2013.01); *B26F 1/02* (2013.01); *B26D 7/18* (2013.01); *B26D 2007/0018* (2013.01)

USPC ..... 83/618; 83/72; 83/631; 83/684

(58) Field of Classification Search

USPC ..... 83/167, 613, 616, 618, 629, 631, 684, 83/686–688, 698.71, 698.91, 72, 74, 76.1, 83/364, 372

See application file for complete search history.

(56) References Cited

U.S. PATENT DOCUMENTS

| | | | | |
|---|---|---|---|---|
| 6,540,451 | B1 * | 4/2003 | Mori | 408/135 |
| 8,770,078 | B2 * | 7/2014 | Baba et al. | 83/618 |
| 8,770,079 | B2 * | 7/2014 | Baba et al. | 83/618 |
| 2002/0069736 | A1 * | 6/2002 | Yasoda et al. | 83/62.1 |

FOREIGN PATENT DOCUMENTS

| | | |
|---|---|---|
| KR | 1999-0034187 | 8/1999 |
| KR | 20100084347 | 7/2010 |

* cited by examiner

*Primary Examiner* — Phong Nguyen

(74) *Attorney, Agent, or Firm* — DeLio, Peterson & Curcio LLC; Peter W. Peterson

(57) ABSTRACT

The present disclosure provides an automatic electric punching apparatus that can automatically punch documents or paper sheets by lowering a screw punch blade by means of a screw while being rotated in conjunction with driving of a motor due to switching.

5 Claims, 5 Drawing Sheets

AUTOMATIC ELECTRIC PUNCHING APPARATUS

BACKGROUND OF THE INVENTION

1. Field of the Invention

The present invention relates to an automatic electric punching apparatus, and more particularly, to an automatic electric punching apparatus that can automatically and conveniently perform a punching operation on a plurality of documents or paper sheets by providing the punching apparatus with a specific structure by means of a small-sized motor and a screw punch blade.

2. Description of Related Art

In general, a standard binder or a file is used to collect a plurality of documents or paper sheets for a long time, in which case in order to file the documents or paper sheets by using the binder or file, a pair of holes are punched at a predetermined interval at predetermined locations of the documents or paper sheets by using a punching apparatus.

Then, an electric punching apparatus according to the related art generally employs a heavy motor, and accordingly, has a complex structure and consumes high manufacturing costs. Further, since most electric punching apparatuses are of one hole type and operated in a compulsory press manner or a pipe type punch blade rotation manner, a punching operation cannot be easily performed.

In addition, although a punching apparatus for punching a hole in various documents or paper sheets generally has a push handle at an outside of a body thereof so that a user can push down the handle with his or her hands to manually lower a punching unit, it is very troublesome to use the punching apparatus. Although automatic punching apparatuses are used as an alternative, most of them are suitable for industrial mass punching and cannot be used for the purposes of offices or homes.

Patent Document—Korean Unexamined Patent Publication No. 1997-0020351

SUMMARY OF THE INVENTION

Accordingly, the present invention has been made to solve the above-mentioned problems occurring in the prior art, and an object of the present invention is to provide an automatic electric punching apparatus that can automatically punch documents or paper sheets by lowering a screw punch blade by means of a screw while being rotated in conjunction with driving of a motor due to switching.

In order to accomplish this object, there is provided an automatic electric punching apparatus including: a body including a plate-shaped base member provided with a pair of punch pads at a rear side of an upper surface thereof, a lower block having a rectangular parallelepiped shape and in which a pair of bushing nuts are vertically buried, the lower block defining a paper insertion opening having a predetermined interval at a rear side of an upper surface of the base member, an upper block installed at an upper side of the lower block to be moved upward and downward and in which a pair of bearings are buried, and a cover covering the upper block and the lower block; a driving unit including a motor positioned on and fixed to a upper surface of the upper block while a rotary shaft thereof passes through the upper block, a driving gear mounted to the rotary shaft of the motor and installed on a lower surface of the upper block, and a pair of driven gears engaged with the driving gear to be rotated; a punching unit including a pair of screw punches provided for punching at lower ends thereof, having a tubular shape having a screw thread on an outer peripheral surface thereof, mounted to bearings of the upper block while an upper end thereof passing through the driven gears, and having central portions coupled to the bushing nuts buried in the lower block to be moved upward and downward; and a control unit including a switch unit installed on a front surface of the cover, a sensing unit for restricting an upward and downward movement distance of the upper block by means of the screw punches and the bushing nuts, and a printed circuit board for controlling driving of the motor according to signal inputs from the switch unit and the sensing unit.

Preferably, a balance rod is fixedly installed downward at a predetermined point of a lower surface of the upper block and a cylinder hole is formed in the lower block corresponding to the balance rod so that the upper block is prevented from being arbitrarily moved through a guide operation of the balance rod and the cylinder hole when the upper block is moved upward and downward.

Preferably, the sensing unit includes: a pair of photo sensors vertically arranged on one surface of the lower block to be spaced apart from each other by a predetermined interval; and a detection bar having a bar shape of a predetermined length and fixedly installed on one surface of the upper block toward the photo sensor to act as a shield.

Further, expansion parts having predetermined spaces are formed at lower sides of the pair of punching pads of the base member so that punch chips are collected by the expansion parts, and caps for opening the expansion parts are provided on a bottom surface of the base member.

Preferably, guide pipes communicating with upper ends of the pair of screw punches are provided on an upper surface of the upper block, and the guide pipes are connected to a collection box provided at a rear side of the base member by means of pipes.

As described above, according to the present invention, since a screw punch blade having a specific structure is automatically rotated and lowered to automatically punch documents or paper sheets as a motor is driven according to manipulation of a switch on a front side of a body, a user can very conveniently perform a punching operation without using a separate push handle.

In addition, as the punching apparatus has a very simplified electric structure, manufacturing costs can be reduced by simplifying components and an assembly process thereof. Further, an outer design is so appealing that it can meet a satisfaction of a user.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-4B of the drawings in which like numerals refer to like features of the invention.

Figure 1:
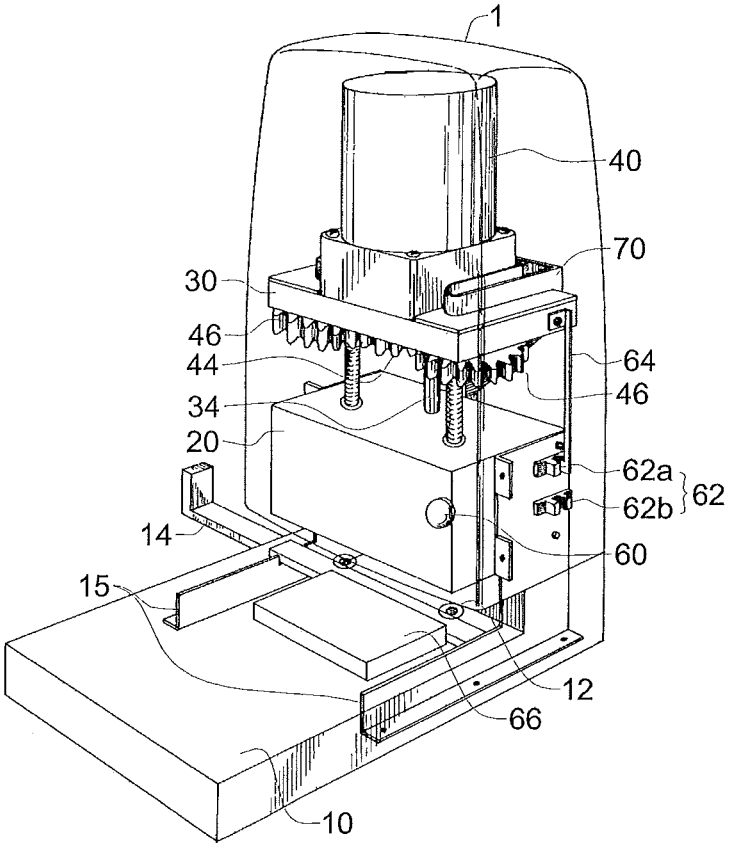
FIG. 1 is a perspective view illustrating a configuration of an automatic electric punching apparatus according to the present invention.
Figure 2:
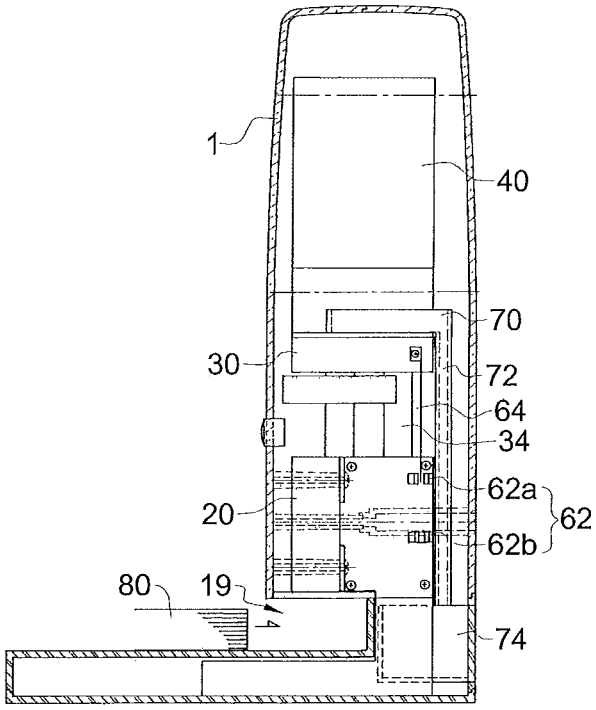
FIG. 2 is a side view illustrating the configuration of the automatic electric punching apparatus according to the present invention.
Figure 3:
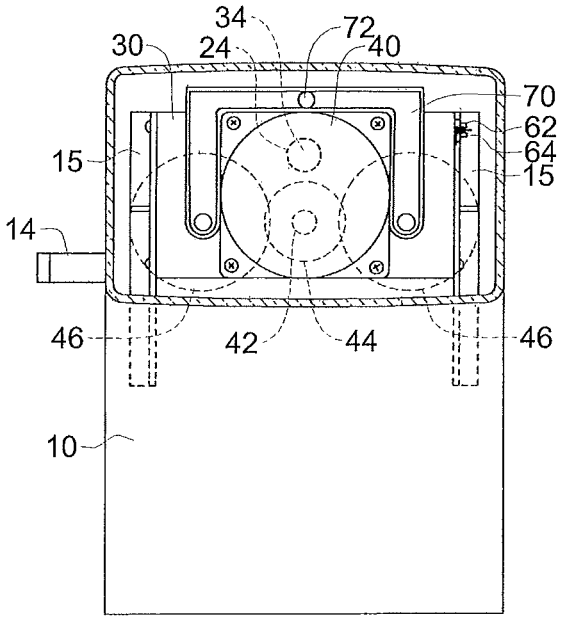
FIG. 3 is a plan view illustrating the configuration of the automatic electric punching apparatus according to the present invention.
Figure 4A:
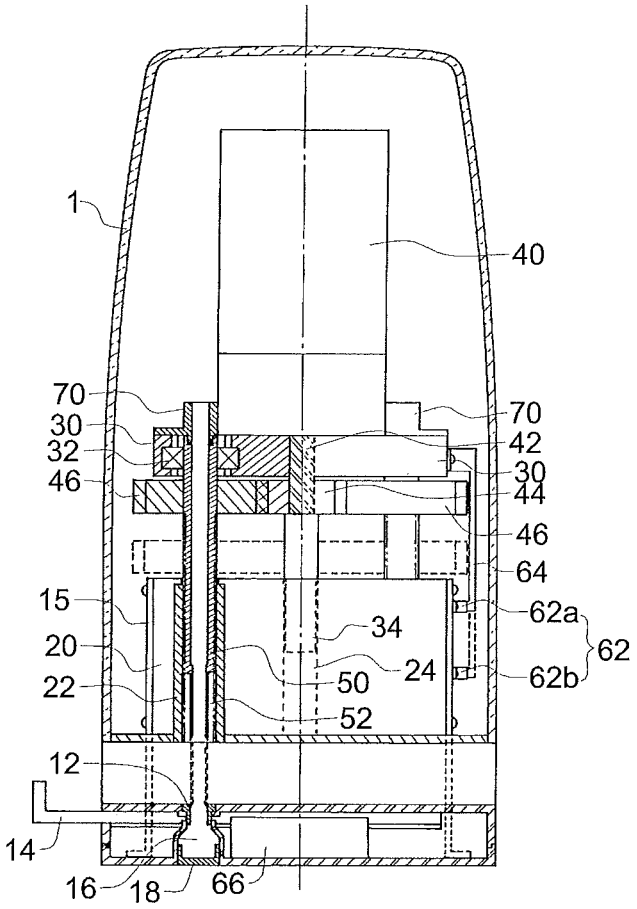
FIGS. 4A and 4B are sectional views illustrating an operation of the automatic electric punching apparatus according to the present invention.
Figure 4B:
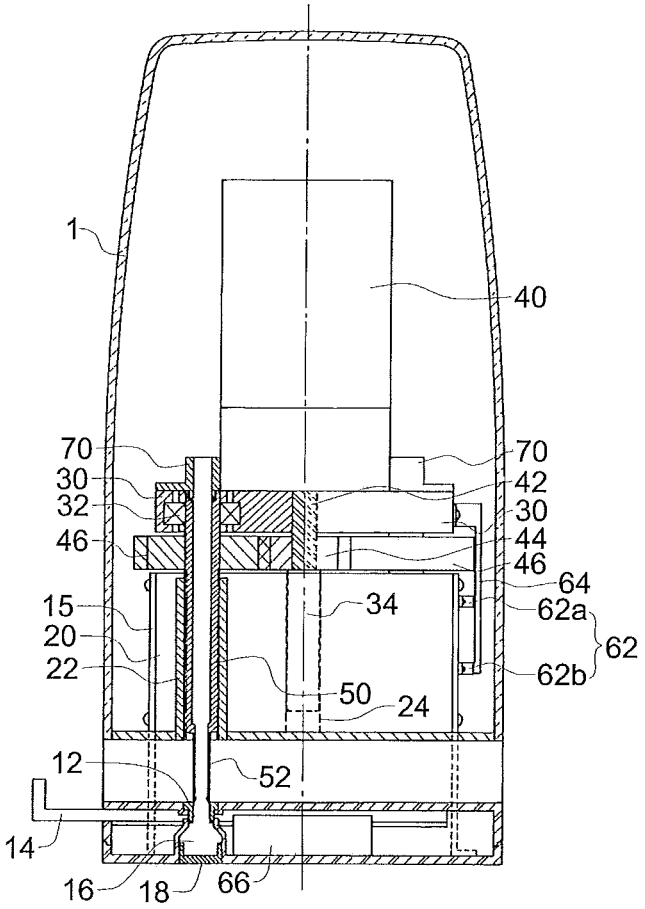

FIG. 1 is a perspective view illustrating a configuration of an automatic electric punching apparatus according to the present invention. FIG. 2 is a side view illustrating the configuration of the automatic electric punching apparatus according to the present invention. FIG. 3 is a plan view illustrating the configuration of the automatic electric punching apparatus according to the present invention. FIGS. 4A and 4B are sectional views illustrating an operation of the automatic electric punching apparatus according to the present invention.

First, in the automatic electric punching apparatus according to the present invention, a pair of screw punches 50 are automatically rotated through driving of a motor 40 and is lowered by means of a screw thread as a user manipulates a switch unit 60 provided on a front surface of a cover 1 of the punching apparatus, so that documents or paper sheets 80 can be automatically punched.

To this end, the automatic electric punching apparatus according to the present invention includes an apparatus body including a base member 10, an upper block 30, a lower block 20, and a cover 10, and a driving unit, a punching unit, and a control unit having specific structures are installed in the body.

First, the body of the automatic electric punching apparatus has a substantially tetragonal plate shape. A known scale 15 for adjusting a punching point of the documents or paper sheets 80, which are to be punched, and a scale support member 14 are provided at one side of the body. The base member having a pair of punch pads 12 is provided at a rear side of an upper surface of the body. The lower block 20 having a substantially rectangular parallelepiped shape is installed at a rear side of the base member 10. The lower block 20 is integrally formed with the base member 10 while a paper insertion opening 19 is formed at a predetermined point of an upper surface of the base member 10 with a pair of bushing nuts 22 being vertically installed in the interior of the lower block 20.

The upper block 30 is installed at an upper side of the lower block 20 to be moved upward and downward by a predetermined height by means of a pair of screw punches 50, and a pair of bearings 32 are installed in the interior of the upper block 30.

Then, a balance rod 34 having a predetermined length is fixedly installed downward at a predetermined point of a lower surface of the upper block 30 and a cylinder hole 24 is formed on an upper surface of the lower block 20 corresponding to the balance rod 34 so that the upper block 30 can be prevented from being arbitrarily moved through a guide operation of the balance rod 34 and the cylinder hole 24 when the upper block 30 is moved upward and downward.

Expansion parts 16 are formed at lower portions of the pair of punch pads 12 provided in the base member 10 to be expanded to predetermined spaces so that punch chips due to a punch operation can be collected in the expansion parts 16, and caps 18 for opening the expansion parts 16 are formed on a bottom surface of the base member 10 corresponding to the expansion parts 16 to be opened and closed.

A cover 1 having various designs covers outer surfaces of the upper block 30 and the lower block 20 to protect the product and make the product appealing.

A motor 40 positioned on and fixed to an upper surface of the upper block 30 to provide power is provided in the driving unit such that a rotary shaft 42 of the motor 40 faces downward while passing through the upper block 30, a driving gear 44 is mounted to the rotary shaft 42 of the motor 40 to be installed on a lower surface of the upper block 30, and a pair of driven gears 46 rotated in conjunction with the driving gear 44 are provided at opposite sides of the driving gear 44 while being installed on a lower surface of the upper block.

The punching unit 50 is operated by means of the driving unit, and includes a pair of screw punches 50 for applying an external force to paper sheets and documents 80 inserted into the paper insertion opening 19 facing the base member 10 to perform a punching operation. A punch 52 for punching is provided at a lower end of each of the screw punches 50, and a tube shape having a screw thread is provided on an outer peripheral surface of the screw punch 50. The screw punches 50 are mounted to the bearings 32 of the upper block 30 while upper ends thereof pass through the driven gears 46 and central portions of the screw punches 50 are engaged with the bushing nuts 22 installed in the lower block 20 so that the screw punches are moved upward and downward by means of the bushing nuts 22 while being moved in conjunction with rotation of the driven gears 46.

In a configuration of the control unit for performing a punching operation on a large number of paper sheets or documents 80 by means of the screw punches 50 by controlling the driving unit, the switch unit 60 for manipulation of a user is provided on a front surface of the cover 1, a sensing unit for generating a predetermined signal by detecting an upward and downward movement distance of the upper block 30 by means of the screw punches 50 and the bushing nuts 22 is provided at one side of the body, and a printed circuit board 66 for controlling driving of the motor 40 according to signal inputs from the switch unit 60 and the sensing unit is embedded in the base member 10.

The sensing unit provided to restrict a movement distance of the upper block 30 preferably includes a pair of photo sensors 62 vertically arranged on one surface of the lower block 20 to be spaced apart from each other by a predetermined interval, and a detection bar 64 having a bar shape of a predetermined length and fixedly installed toward the photo sensor 62 to act as a shield.

Meanwhile, guide pipes 70 communicating with upper ends of the pair of screw punches 50 to remove punch chips discharged from the screw punches 50 having a tubular shape are formed on an upper surface of the upper block 30, and the guide pipes 70 are connected to a collection box 74 provided at a rear side of the base member 10 by means of pipes 72 to be opened and closed so that a large amount of punch chips can be collected and removed.

An exchangeable battery (not shown) for providing electric power for an operation of the automatic electric punching apparatus according to the present invention is embedded on a bottom surface of the base member 10.

Next, an operation of the present invention will be described in detail with reference to the drawings.

In order to perform a punching operation at a predetermined point of a large number of paper sheets or documents by using the automatic electric punching apparatus according to the present invention, first, after the scale 16 provided at one side of the base member 10 is adjusted to a punching location of the paper sheets or documents 80, a bundle of paper sheets or documents 80 to be punched is inserted through the paper insertion opening 19 formed between the base member 10 and the lower block 20.

Thereafter, as a user manipulates the switch unit 60 provided on a front surface of the cover 1 of the automatic electric punching apparatus, electric power from the power supply unit is applied to the motor 40 to drive the motor 40 under the control of the printed circuit board 66. Accordingly, the driving gear 44 mounted to the rotary shaft 42 is rotated in one direction and the pair of driven gears 46 engaged with the driving gear 44 are rotated.

Accordingly, the pair of screw punches 50 installed at central shafts of the pair of driven gears 46 to be rotated in conjunction with the driven gears 46 are lowered together with the upper block 30 according to operations of the bushing nuts 22 embedded in the lower block 20, and thus the punches 52 provided at lower ends of the screw punches 50 perform a punching operation on corresponding points of a number of paper sheets or documents 80 located in the paper insertion opening 19.

Then, during a punching operation through the punches 52 at lower ends of the screw punches 50, the lower ends of the punches 52 contact the punch pads 12 of the base member 10 and the detection bar 64 constituting the sensing unit is located around the photo sensor 62*b* of the pair of photo sensors 62 provided in the lower block 20, which is located on a lower side, so that the photo sensor 62*b* transmits a detection signal to the printed circuit board 66. Accordingly, the printed circuit board 66 performs a control to rotate the rotary shaft 42 of the motor 40 reversely so that the upper block 30 and the screw punches 50 lowered by a predetermined height is moved upward.

As the upper block 30 is raised, a lower end of the detection bar 64 reaches the photo sensor 62*a* of the pair of photo sensors 62 located on an upper side, and the printed circuit board 66 having received a detection signal performs a control to stop driving of the motor 40 to complete a series of punching operations due to manipulation of the switch unit 60 by a user.

It is apparent that the series of punching operations can be repeatedly performed as a user manipulates the switch unit 60.

Most punch chips generated according to the punching operation on the large number of paper sheets and documents 80 may pass through interiors of the screw punches 50 having a tubular shape, and may be collected in the collection box 74 provided at a rear side of the base member 10 through the guide pipes 70 on an upper surface of the upper block 30 and the pipes 72 to be easily discharged to the outside, and the residual punch chips having passed through the holes of the punch pads 12 and having dropped during a punching operation are collected by the expansion parts 16 provided at lower sides of the punch pads 12 of the base member 10 to be conveniently discharged to the outside by means of the cap 18.

Meanwhile, it is apparent that even if modified embodiments different from the contents of the present invention are conceived of, they should not be individually construed from the technical spirit or prospect of the present invention and fall with the scope of the present invention claimed in the claims.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An automatic electric punching apparatus comprising:

a body comprising a plate-shaped base member provided with a pair of punch pads at a rear side of an upper surface thereof, a lower block having a rectangular parallelepiped shape and in which a pair of bushing nuts are vertically buried, the lower block defining a paper insertion opening having a predetermined interval at a rear side of an upper surface of the base member, an upper block installed at an upper side of the lower block to be moved upward and downward and in which a pair of bearings are buried, and a cover covering the upper block and the lower block;

a driving unit comprising a motor positioned on and fixed to a upper surface of the upper block while a rotary shaft thereof passes through the upper block, a driving gear mounted to the rotary shaft of the motor and installed on a lower surface of the upper block, and a pair of driven gears engaged with the driving gear to be rotated;

a punching unit comprising a pair of screw punches provided for punching at lower ends thereof, having a tubular shape having a screw thread on an outer peripheral surface thereof, mounted to bearings of the upper block while an upper end thereof passing through the driven gears, and having central portions coupled to the bushing nuts buried in the lower block to be moved upward and downward; and a control unit comprising a switch unit installed on a front surface of the cover, a sensing unit for restricting an upward and downward movement distance of the upper block by means of the screw punches and the bushing nuts, and a printed circuit board for controlling driving of the motor according to signal inputs from the switch unit and the sensing unit.

2. The automatic electric punching apparatus as claimed in 1, wherein a balance rod is fixedly installed downward at a predetermined point of a lower surface of the upper block and a cylinder hole is formed in the lower block corresponding to the balance rod so that the upper block is prevented from being arbitrarily moved through a guide operation of the balance rod and the cylinder hole when the upper block is moved upward and downward.

3. The automatic electric punching apparatus as claimed in 1, wherein the sensing unit comprises:

a pair of photo sensors vertically arranged on one surface of the lower block to be spaced apart from each other by a predetermined interval; and a detection bar having a bar shape of a predetermined length and fixedly installed on one surface of the upper block toward the photo sensor to act as a shield.

4. The automatic electric punching apparatus as claimed in 1, wherein expansion parts having predetermined spaces are formed at lower sides of the pair of punching pads of the base member so that punch chips are collected by the expansion parts, and caps for opening the expansion parts are provided on a bottom surface of the base member.

5. The automatic electric punching apparatus as claimed in 1, wherein guide pipes communicating with upper ends of the pair of screw punches are provided on an upper surface of the upper block, and the guide pipes are connected to a collection box provided at a rear side of the base member by means of pipes.

* * * * *